US007419276B2

(12) United States Patent
Sheridan

(10) Patent No.: US 7,419,276 B2
(45) Date of Patent: Sep. 2, 2008

(54) RAIL LIGHTING SYSTEM

(76) Inventor: Richard G. Sheridan, 115 Fenchurch Way, Neptune, NJ (US) 07753

( * ) Notice: Subject to any disclaimer, the term of this patent is extended or adjusted under 35 U.S.C. 154(b) by 0 days.

(21) Appl. No.: 11/421,151

(22) Filed: May 31, 2006

(65) Prior Publication Data

US 2007/0279898 A1 Dec. 6, 2007

(51) Int. Cl.
*F21S 8/00* (2006.01)

(52) U.S. Cl. ..... 362/152; 362/151

(58) Field of Classification Search ..... 362/152, 362/146, 240

See application file for complete search history.

(56) References Cited

U.S. PATENT DOCUMENTS 2,310,593 A * 2/1943 Orlicki ..... 362/146
2,766,372 A * 10/1956 Albris ..... 362/146
6,425,676 B1 * 7/2002 Lyons ..... 362/152
7,168,843 B2 * 1/2007 Striebel ..... 362/652
2007/0279898 A1 * 12/2007 Sheridan ..... 362/152
2007/0279899 A1 * 12/2007 Sheridan ..... 362/152

OTHER PUBLICATIONS

Aurora Deck Lighting Brochure, 10 pages, date unknown.
Home Tops Brochure, Jan. 2006, 4 pages.
LMT—Mercer Group Inc. brochure, 1 page, date unknown.
Ventana USA®, Curved Vinyl Deck Railing Profile Specification Brochure, 3 pages, date unknown.
LMT-Mercer Group, Inc. brochure, 1 page, date unknown.

* cited by examiner

*Primary Examiner*—Anabel M Ton
(74) *Attorney, Agent, or Firm*—Patterson & Sheridan, LLP

(57) ABSTRACT

An improved lighted rail system is provided in the present invention. In one embodiment, the lighted rail system includes a rail member having a plurality of spindle-receiving holes formed in a first side, at least one wire routed through the rail member; and a plurality of light elements coupled to the wire. In another embodiment, a rail member utilized in a lighted rail system includes an upper portion of a rail member having a conduit formed therein, a spindle-receiving portion configured to receive a spindle, a spindle stop formed in the rail member separating the conduit from the spindle-receiving portion, and a lighting system disposed in the rail member.

19 Claims, 6 Drawing Sheets

RAIL LIGHTING SYSTEM

BACKGROUND OF THE INVENTION

1. Field of the Invention

Embodiments of the present invention generally relate to rail lighting system suitable for use deck rails, fences and the like.

2. Background

Conventional deck and fence lighting systems are typically mounted to the posts that support one or more sections of rails or fences. Many such lighting systems are mounted on top of the post, which is at or near eye level. This elevation of the lighting system undesirably produces uncomfortable glare that reduces the enjoyment of the area.

Therefore, there is a need for an improved lighting system.

SUMMARY OF THE INVENTION

An improved lighted rail system is provided in the present invention. In one embodiment, the lighted rail system includes a rail member having a plurality of spindle-receiving holes formed in a first side, at least one wire routed through the rail member, and a plurality of light elements coupled to the wire.

In another embodiment, a rail member utilized in a lighted rail system includes an upper portion of a rail member having a conduit formed therein, a spindle-receiving portion configured to receive a spindle and a spindle stop formed in the rail member separating the conduit from the spindle-receiving portion. A light system is disposed in the rail member.

In yet another embodiment, the rail member includes an upper portion of a rail member having a conduit formed therein, a spindle-receiving portion configured to receive a spindle and a spindle stop formed in the rail member separating the conduit from the spindle-receiving portion. A light system is disposed in the rail member and positioned such that light emitted therefrom passes through an aperture formed in the rail member.

The lighted rail system is suitable for incorporation into deck rails, hand rails, fences and the like. The lighted rail system may be utilized as the top rail, a bottom rail, or in a position between the top and bottom rails.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
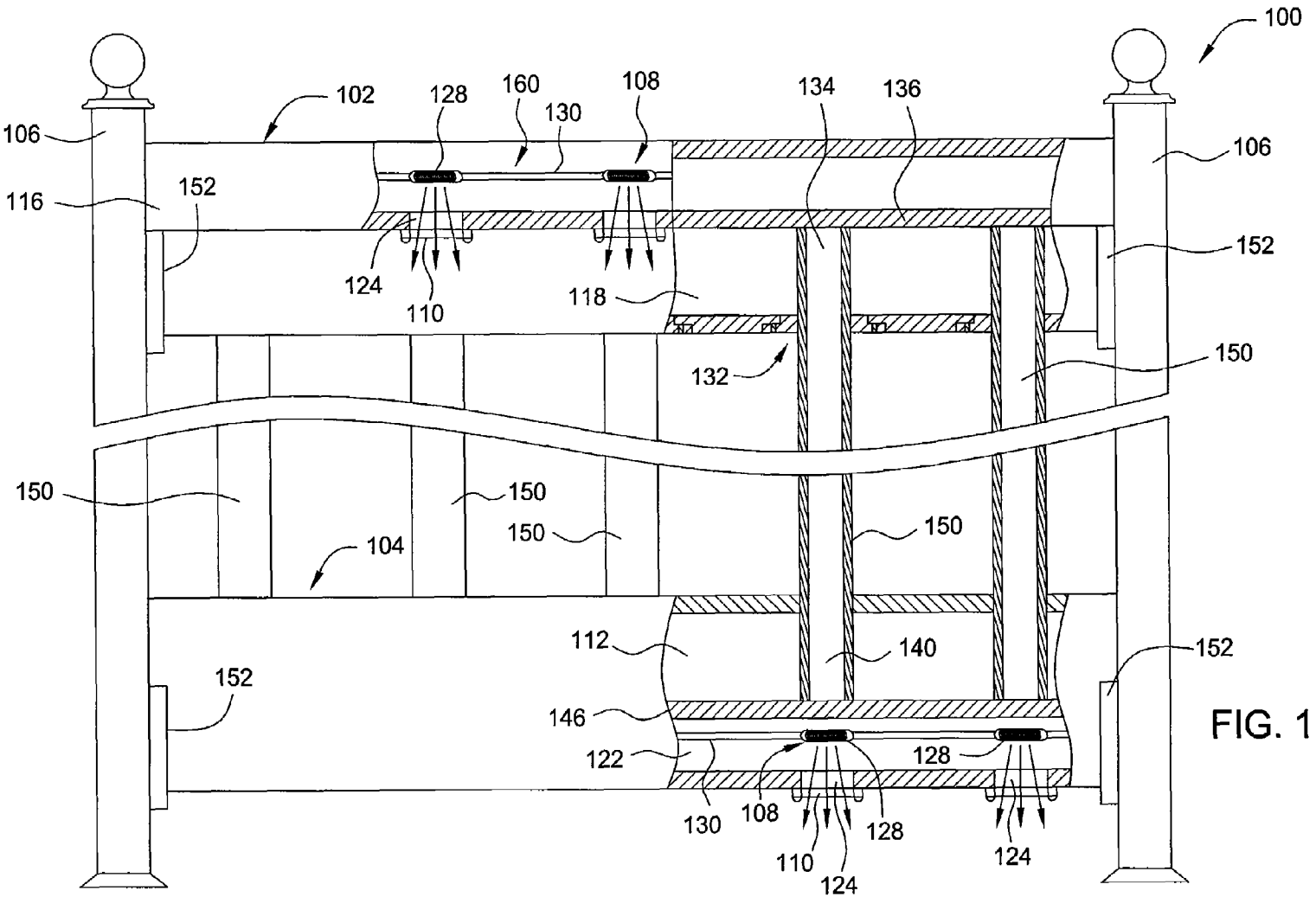
FIG. 1 is a partial cutaway view of one embodiment of a lighted rail member incorporated into a deck rail section.

To facilitate understanding, identical reference numerals have been used, where possible, to designate identical elements that are common to the figures. It is also contemplated that elements and features of one embodiment may be beneficially incorporated on other embodiments without further recitation.

DETAILED DESCRIPTION

A lighted rail system is provided that is suitable for incorporation into deck rails, hand rails, fences and the like. In certain embodiments, lighted rail system provides indirect, accent and/or pathway illumination without the uncomfortable eye-level glare associated with conventional post-mounted lighting.

FIG. 1 is a partial cut-away view of one embodiment of a lighted rail member of the present invention incorporated into a deck rail section 100. Although the lighted rail member is shown incorporated in a deck rail, it is intended that the rail section 100 be representative of fences, hand rails and the like.

In the embodiment depicted in FIG. 1, the deck rail section 100 includes a first rail member 102, a second rail member 104 and a plurality of spindles 150 coupling the rail members 102, 104 in a spaced-apart relation. At least one of the rail members 102, 104 includes a lighting system 108. Multiple lighting systems 108 may be disposed in the first rail member 102 and/or the second rail member 104. In the embodiment depicted in FIG. 1, lighting systems 108 are disposed in both the first and second rail members 102, 104. The lighting system 108 is configured to provide indirect and/or accent lighting such that little or no eye-level glare is generated. The lighting system 108 may also be configured to provide pathway or task lighting. Embodiments of the lighting system 108 are discussed in further detail below.

The post 106 supports the deck rail section 100 above a surface, such as a deck, stairs, porch, ground or other structure. The post 106 may be fabricated from stone, wood, metal, plastic, fiberglass or other suitable material. In one embodiment, the post 106 is a hollow plastic square tube. The rail members 102, 104 may be coupled to posts 106 by mounting assemblies 152. It is also contemplated that the members 102, 104 may be coupled to the posts 106 by alternative methods.

Figure 2:
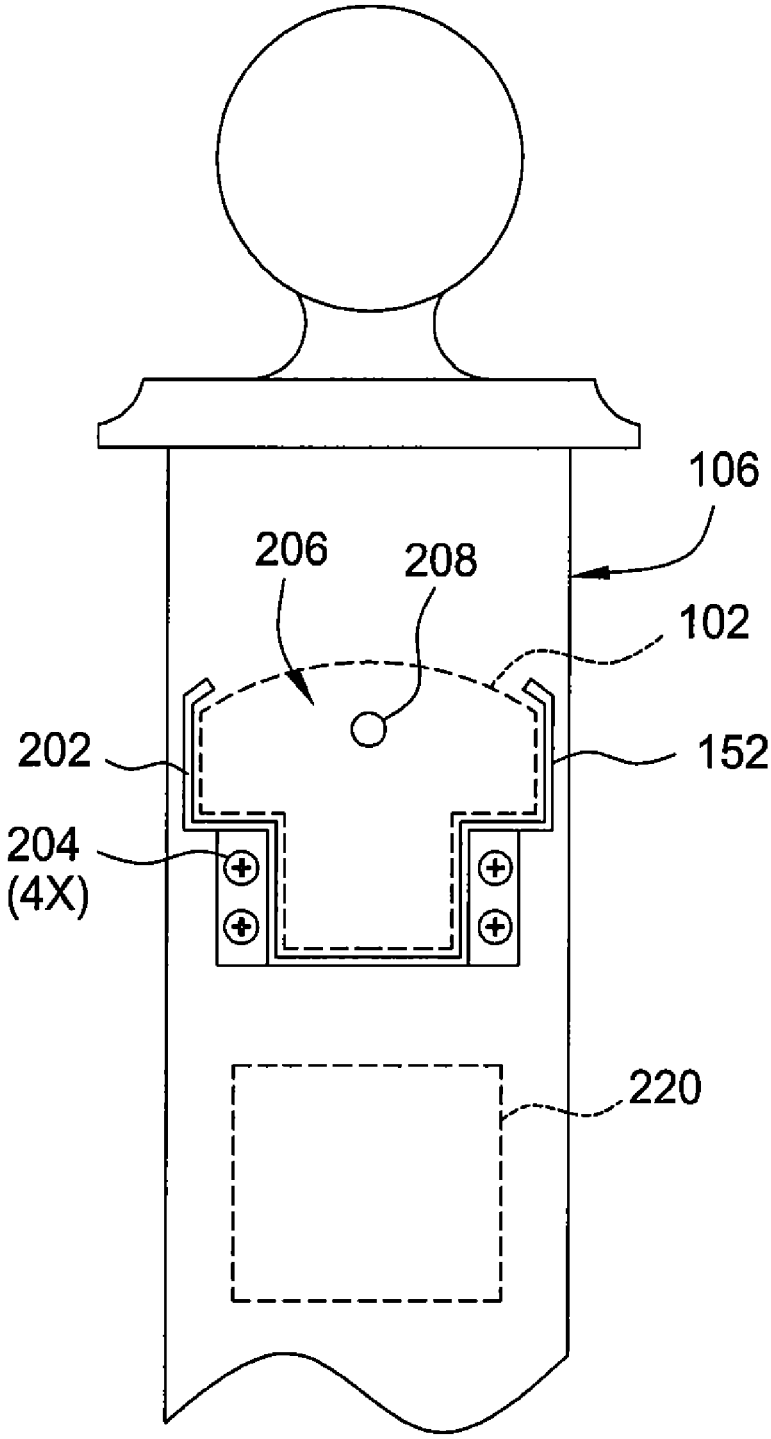
FIG. 2 is a front view of one embodiment of a mounting assembly.

FIG. 2 depicts one embodiment of the mounting assembly 152 coupled to the post 106. The mounting assembly 152 includes a bracket 202 that is fastened to the post 106, for example, by fasteners 204. The fasteners 204 may be screws, rivets or other suitable fasteners or adhesive. The bracket 202 defines a rail receiving pocket 206 that at least partially circumscribes and retains the rail member 104 to the post 106 in a predetermined location. A hole 208 is formed in the post 106 and may be aligned with the rail receiving pocket 206 to facilitate wiring of the lighting system 108 between rail members through the post 106.

Returning to FIG. 1, the rail members 102, 104 may be fabricated from a suitable material, such as wood, metal, plastic or fiberglass. The rail members 102, 104 may be extruded into a hollow form. In one embodiment, the rail members 102, 104 are formed from extruded plastic, such as polyvinyl chloride (PVC) or PVC with $TiO_2$ (titanium dioxide) fillers, among other materials. The spindles 150 may be similarly constructed.

Figure 3A:
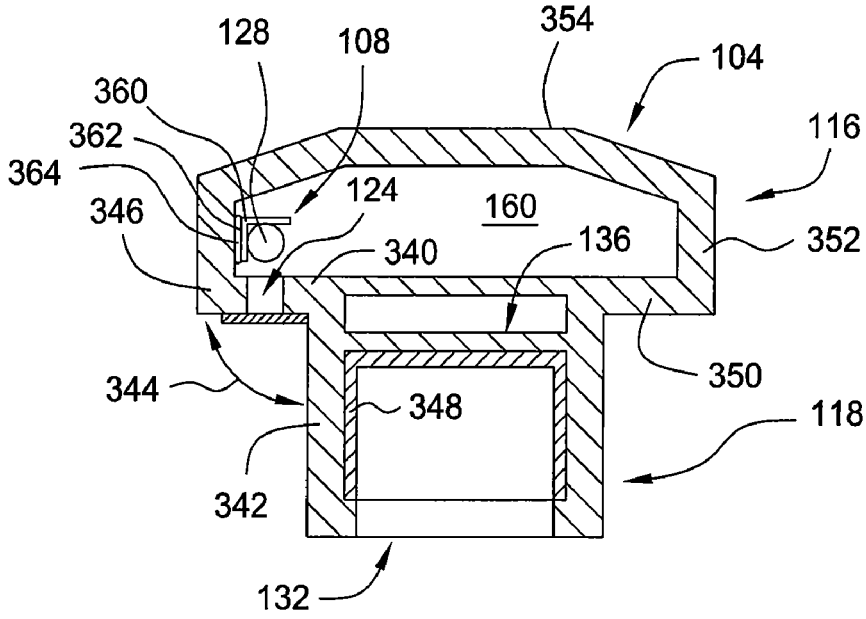
FIGS. 3A-B are sectional views of one embodiment the lighted rail member of FIG. 1.
Figure 3B:
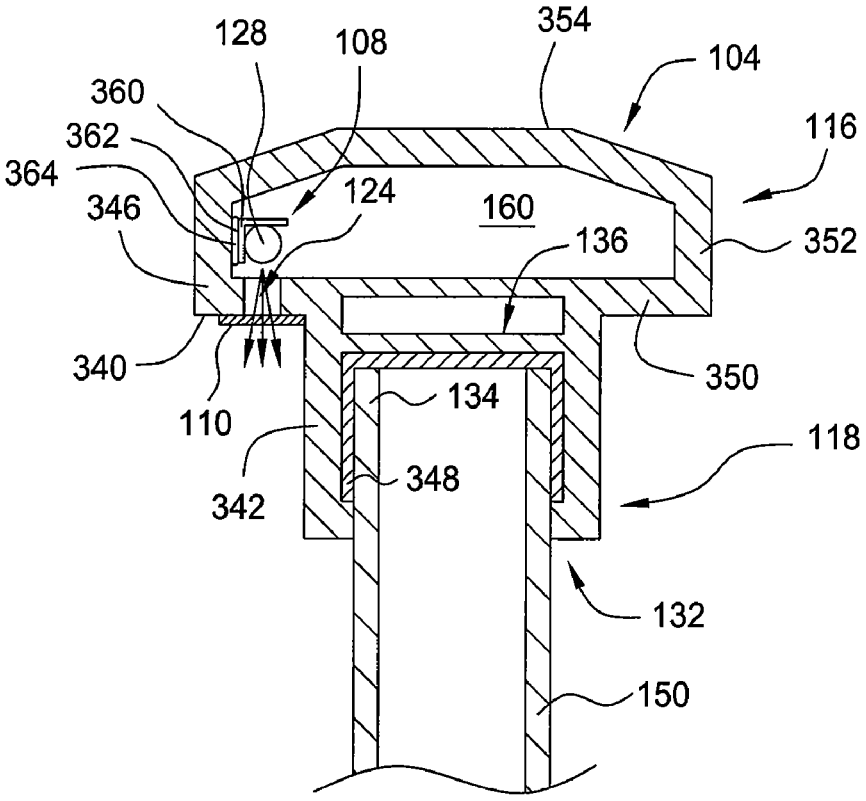

Referring additionally to the sectional view of the first rail member 102 in FIGS. 3A-B, the first rail member 102 includes an upper portion 116 and a spindle-receiving portion 118. The spindle-receiving portion 118 includes one or more spindle-receiving holes 132 sized to receive a first end 134 of the spindle 150. A spindle stop 136 is formed in the interior of the first rail member 102. A first end 134 of the spindle 150 is inserted through the spindle-receiving hole 132 and abuts the spindle stop 136 so that the spindle 150 extends a predetermined length from the first rail member 102.

The spindle stop 136 may be a rib or other suitable feature extending inward from the walls of the first rail member 102. In the embodiment depicted in FIGS. 3A-B, the spindle stop 136 is an internal wall formed in the first rail member 102 separating the upper portion 116 from the spindle-receiving portion 118.

The second rail member 104 includes a spindle-receiving portion 112 and a spindle stop 146 which are configured to mate with a second end 140 of the spindle 150. Thus, when the spindles 150 are inserted into the spindle-receiving portions 118, 112 of the rail members 102, 104, the rail members 102, 104 are maintained in a substantially parallel or other predefined space-apart relation.

The spindle-receiving portions 118, 112 of the rail members 102, 104 may optionally include a stiffening insert 348 to increase the mechanical the mechanical properties of the assembly. In one embodiment, the stiffening insert 348 is an aluminum extrusion. Optionally, the stiffening insert 348 may be disposed in the posts 106 and/or spindles 150.

The upper portion 116 of the first rail member 102 provides a conduit 160 through which the lighting system 108 is routed. In the embodiment depicted in FIGS. 3A-B, the upper portion 116 includes at least a first flange 340 extending laterally from a sidewall 342 of the first rail member 102. The first flange 340 may be oriented perpendicular or at an obtuse angle relative to the spindles 150, as indicated by arrow 344.

The first flange 340 is coupled to a first outer-most wall 346 that is laterally spaced from the sidewall 342. In one embodiment, the outer-most wall 346 is oriented substantially parallel to the sidewall 342.

The first rail member 102 may include a second flange 350 and a second outer-most wall 352 that are formed in the mirror image of the first flange 340 and outer-most wall 346. The first and second outer-most walls 346, 352 are coupled by a top wall 354. The top wall 354 generally forms the upper surface of the first rail member 102, and may have a curved, rounded, flat, polygonal or other profile.

At least one light hole or aperture 124 is formed through the first rail member 102 and configured to allow light emitted by the lighting system 108 to pass therethrough. In the embodiment depicted in FIG. 1 and FIGS. 3A-B, a plurality of apertures 124 are formed through the first flange 340 of the first rail member 102. As the first flange 340 is arranged at an angle parallel to or below the horizon, light emitted through the aperture 124 is directed away from eye-level. Moreover, the apertures 124 may be arranged aligned with (as shown in FIG. 1), or alternatively offset from the spindle-receiving holes 132, so that one or more sides of the spindles 150 may be illuminated.

The lighting system 108 include at least one lighting element 128 arranged to interface with at least one aperture 124. The lighting element 128 may be a low voltage lamp, an incandescent bulb, a fluorescent fixture or other light source.

In the embodiment depicted in FIG. 1 and FIGS. 3A-B, a plurality of lighting elements 128 are shown, each positioned aligned an aperture 124 in the first rail member 102. At least one wire 130 is routed through the conduit 160 defined in the upper portion 116, coupling lighting elements 128 disposed therein. The wire 130 may couple the lighting elements 128 in series or parallel. In embodiments wherein the lighting elements 128 are low voltage lamps, the wire 130 is coupled to transformer 220, which may be located in one of the posts 106 or other suitable location, as shown in phantom in FIG. 2.

Each lighting element 128 may also include a mounting assembly 360. The mounting assembly 360 may be coupled to the first member 102 by an adhesive so that the lighting element 128 is maintained in a predetermined position relative to an associated aperture 124. In the embodiment depicted in FIGS. 3A-B, the mounting assembly 360 includes a tab 362 that is coupled to the first outer-most wall 346 by an adhesive 364. A lens 110 may be respectively coupled to the first rail member 102 over each the apertures 124 to protect the lighting element 128 and prevent water and/or insect intrusion into the first rail member 124.

Figure 3C:
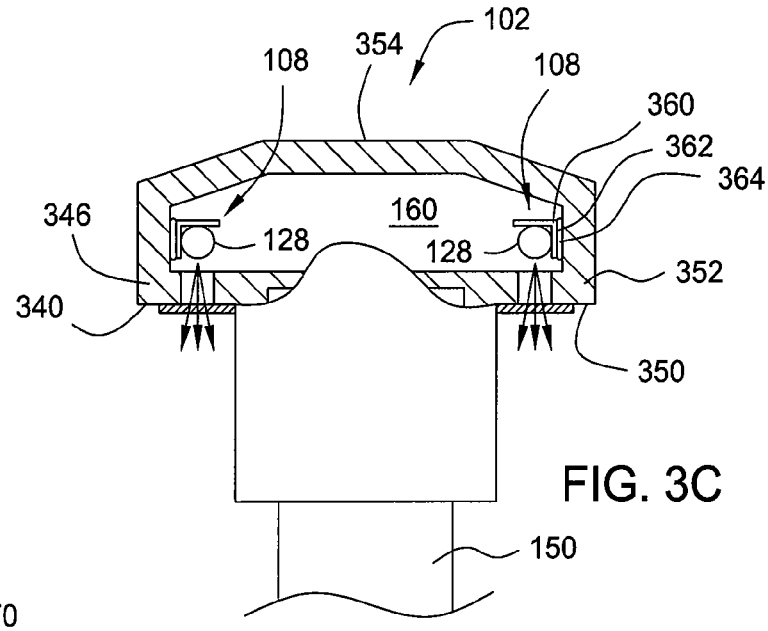
FIGS. 3C-E are a bottom and sectional views of alternative embodiments of a lighted rail member.
Figure 3D:
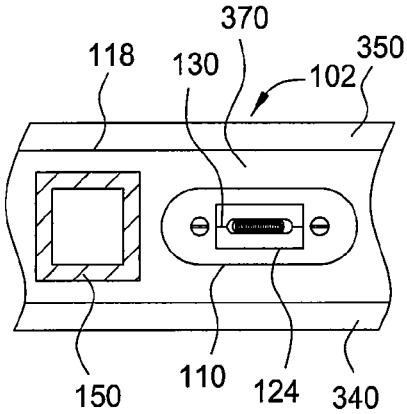
Figure 3E:
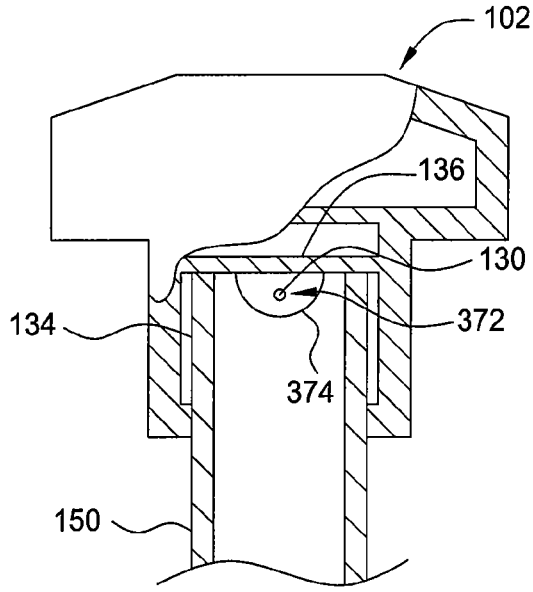

Although the lighting system 108 is shown interfacing with apertures 124 formed in the first flange 340, it is contemplated that the lighting assembly 108, or second lighting assembly may be positioned to provide light through other apertures 124 in the second flange 350 (as shown in FIG. 3C) and/or other portion of the first rail member 102, such as in a bottom wall 320 of the spindle-receiving portion 118 (as shown in FIG. 3D). In embodiments wherein the lighting assembly 108 includes portions disposed in the spindle-receiving portion 118, a hole or passage 352 may be provide through the spindle stop 136 to allow the wiring to pass through the conduit 160. Alternatively as shown in FIG. 3E, a conduit 372 may be defined by a notch 374 formed in the first end 134 of the spindle 150.

Figure 4A:
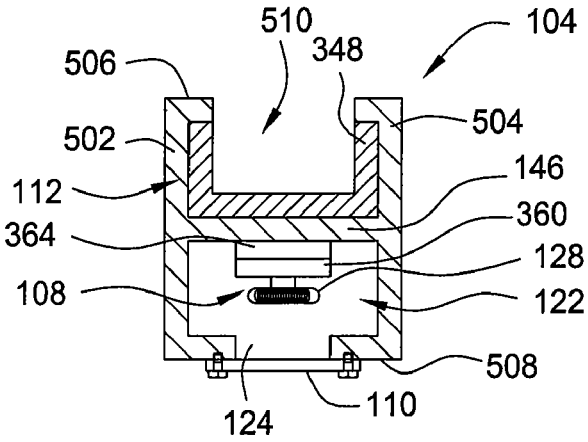
FIGS. 4A-C are sectional views of another embodiment of a lighted rail member.
Figure 4B:
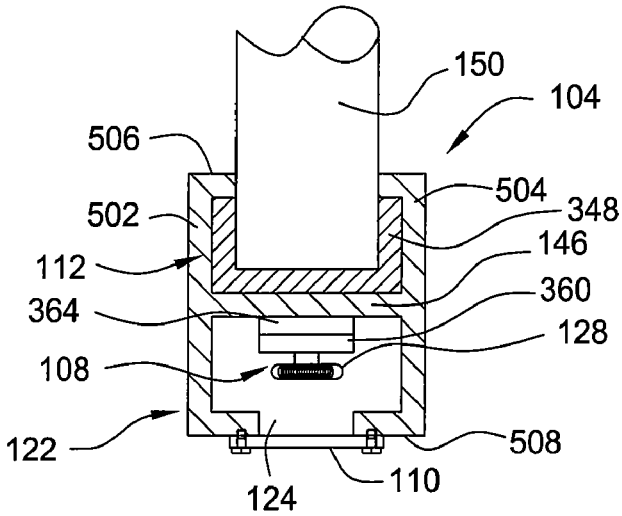
Figure 4C:
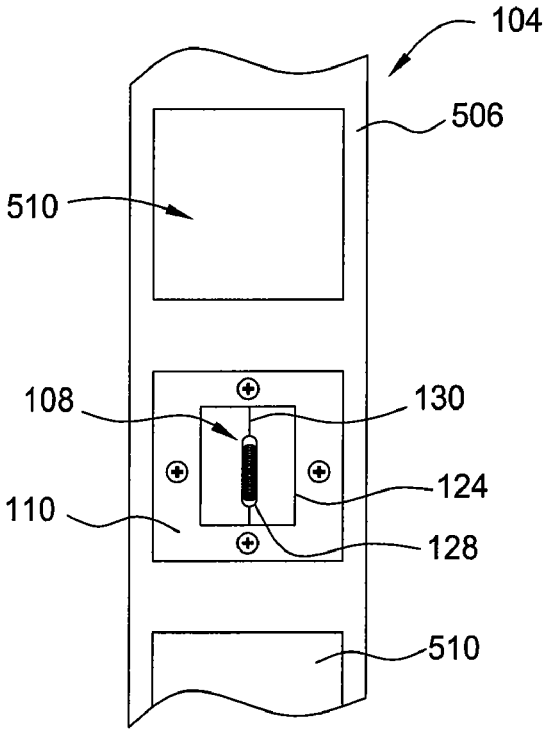

Referring now to FIG. 1 and FIGS. 4A-B, the second rail member 104 has two opposing sidewalls 502, 504, a top wall 506 and a bottom wall 508. The top wall 506 has the spindle-receiving holes 510 formed therethrough. The interior of the second rail member 104 includes a lower portion 122 separated from the spindle-receiving portion 112 by the spindle stop 146. The spindle stop 146 is configured and functions similar to the spindle stop 136 described above.

The lower portion 122 of the second rail member 104 may optionally include a light system 108 disposed therein. The lighting system 108 is configured as described above and may include at least one lighting element 128 arranged to provide illumination through one or more apertures 146 formed in the second rail member 104. In the embodiment depicted in FIG. 1 and FIGS. 5A-B, the apertures 146 are formed in the bottom wall 508. It is contemplated that the apertures 146 may also be formed in at least one of the top wall 506 (as shown in FIG. 5C) or the sidewalls, 502, 504. A lens 110 may be coupled to the second rail member 104 to protect the lighting element 128 as described above.

The mounting assembly 360 of the lighting system 108 is coupled to second rail member 106 by an adhesive or fastener. In the embodiment depicted FIGS. 4A-B, the mounting assembly 360 is coupled to the sidewall 502, spindle stop 146 or top wall 506 by an adhesive 550. A lens 110 may be respectively coupled to the second rail member 106 over each of the apertures 124 to protect the lighting element 128 and prevent water and/or insect intrusion into the rail member.

Figure 5:
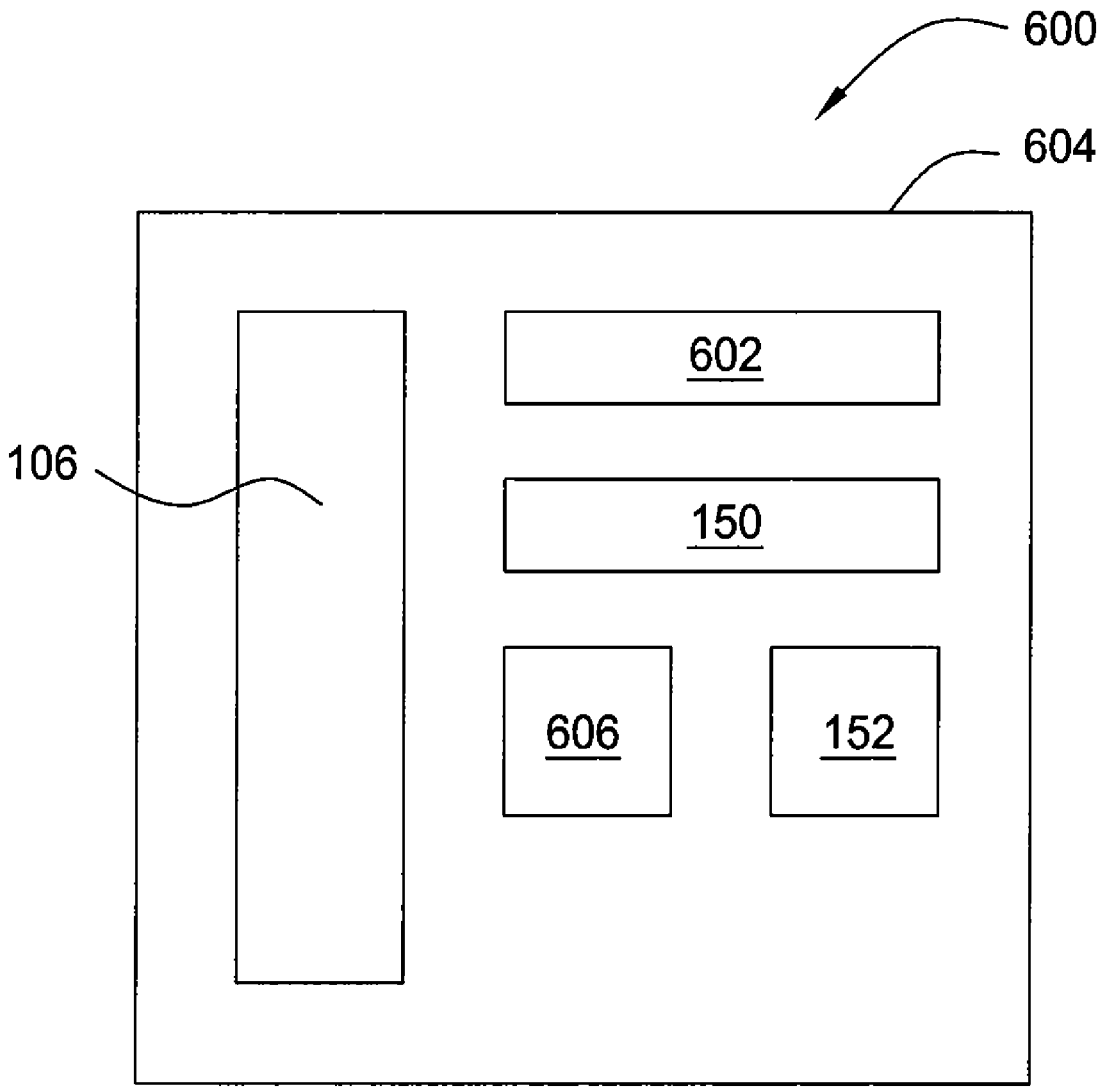
FIG. 5 is a block diagram of a kit containing a lighted rail assembly.

FIG. 5 is a block diagram of a kit 600 containing at least one lighted rail member 602. The lighted rail member 602 may be any lighted rail member contemplated by the present invention. The kit 600 generally includes a container 604 suitable for shipping the lighted rail member 602, such as a corrugated box, among others. The kit 600 may additionally at least one or more of spindles 150, posts 108, mounting assemblies 152 and associated installation hardware 606 for assembling a rail section from the kit components. Advantageously, the kit 600 allows for efficient modular fabrication of deck and fence sections while minimizing the need for costly custom fabrication.

Thus, an improved lighted rail system is provided in the present invention. The improved deck lighting system advantageously provides a lighting system disposed in the rail system, thereby allowing the illumination from the light system at a desired elevation and providing accent, indirect or general lighting as desired without the glare associated with conventional lighting systems.

While the foregoing is directed to embodiments of the present invention, other and further embodiments of the invention may be devised without departing from the basic scope thereof, and the scope thereof is determined by the claims that follow.

What is claimed is:

1. A lighted rail system comprising:

a rail member having a hollow spindle-receiving portion and a flange, the flange extending laterally beyond the spindle-receiving portion;

a plurality of spindle-receiving holes formed in a first side of the spindle-receiving portion, the spindle-receiving holes configured to accommodate an end of a spindle;

a plurality of light apertures formed in a first side of the flange, the first side of the flange parallel to and facing the same direction as the first side of the spindle-receiving portion;

at least one wire routed through the flange of the rail member; and a plurality of light elements coupled to the wire.

2. The lighted rail system of claim 1, wherein the rail member further comprises:

a plurality of light apertures formed therein, wherein at least one of the light elements is aligned with a respective one of the light apertures.

3. The lighted rail system of claim 2 further comprising:

a lens coupled to the rail member and covering at least one of the light apertures.

4. The lighted rail system of claim 1, wherein the light elements are disposed within the rail member.

5. A lighted rail system comprising:

a rail member having a plurality of spindle-receiving holes formed in a first side, wherein the rail member further comprises:

a spindle-receiving portion having the spindle-receiving holes formed therein; and a spindle stop configured to allow a spindle inserted into one of the spindle-receiving holes to extend a predefined distance into the rail member; and a flange extending laterally beyond the spindle-receiving portion and having a plurality of light apertures formed therein;

at least one wire routed through the rail member; and a plurality of light elements coupled to the wire.

6. The lighted rail system of claim 5, wherein the spindle stop is an internal wall of the rail member.

7. The lighted rail system of claim 6, wherein the internal wall separates a spindle-receiving portion of the rail member from a conduit defined in the rail member and having the wire routed therethrough.

8. The lighted rail system of claim 5, wherein the spindle stop is an internal rib of the rail member.

9. The lighted rail system of claim 5, wherein the plurality of light apertures and spindle receiving holes face the same direction.

10. A lighted rail system comprising:

a lower rail member having a plurality of spindle-receiving holes formed in a first side at least one wire routed through the lower rail member;

a plurality of light elements coupled to the wire;

a plurality of light apertures formed in the lower rail member facing away from the first sides an upper rail member having a plurality of spindle-receiving holes formed in a first side; and a plurality of spindles, each spindle having a first end configured to mate with the spindle-receiving hole of the upper rail member and a second end configured to mate with the spindle-receiving hole of the lower rail member, the spindles maintaining the upper and lower rail members in a spaced apart relation when inserted into the spindle-receiving holes of the rail members.

11. The lighted rail system of claim 1, wherein the rail member is a hollow extruded tube.

12. The lighted rail system of claim 11, wherein the hollow extruded tube is plastic.

13. The lighted rail system of claim 1 further comprising:

a metal extruded insert disposed in the rail member and separating a spindle-receiving portion adjacent the first side from a conduit portion of the rail member having the wire routed therethrough.

14. A lighted rail system comprising:

a rail member having a plurality of spindle-receiving holes formed in a first side, wherein the rail member further comprises:

a spindle-receiving portion having the spindle-receiving holes formed therein; and a flange extending laterally beyond the spindle-receiving portion and having a plurality of light apertures formed therein;

at least one wire routed through the rail member;

a plurality of light elements coupled to the wire;

a plurality of spindles configured to engage with the rail member through the spindle-receiving holes;

a second rail member having a plurality of spindle-receiving holes configured to engage a second end of the spindles;

mounting assemblies suitable for coupling the rail members to a post; and a container having the rail members, spindles and mounting assemblies disposed therein.

15. A rail member utilized in a lighted rail system comprising:

an upper portion of a rail member having a conduit formed therein;

a spindle-receiving portion configured to receive a spindle;

a spindle stop formed in the rail member separating the conduit from the spindle-receiving portion;

a lighting system disposed in the rail member;

a light aperture formed in the rail member configured to allow light generated from the light system passing therethrough; and a lens covered the light aperture.

16. A rail member utilized in a lighted rail system comprising:

an upper portion of a rail member having a conduit formed therein;

a spindle-receiving portion configured to receive a spindle;

a spindle stop formed in the rail member separating the conduit from the spindle-receiving portion;

a lighting system disposed in the rail member; and a metal extruded insert disposed in the spindle-receiving portion of the rail member.

17. A lighted rail system comprising:

a rail member having a plurality of spindle-receiving holes formed in a first side;

at feast one wire routed through the rail member; and a plurality of light elements coupled to the wire, wherein the rail member further comprises:

a spindle stop configured to allow a spindle inserted into one of the spindle-receiving holes to extend a pre-defined distance into the rail member.

18. The lighted rail system of claim 17, wherein the spindle stop is at least one of an internal wall of the rail member and an internal rib of the rail member.

19. The lighted rail system of claim 18, wherein the internal wall separates a spindle-receiving portion of the rail member from a conduit defined in the rail member and having the wire routed therethrough.

* * * * *